US005896935A

United States Patent [19]

Esko et al.

[11] Patent Number: 5,896,935

[45] Date of Patent: Apr. 27, 1999

[54] ARRANGEMENT IN BOOM FOR ROCK DRILLING UNIT

[75] Inventors: Mauri Esko, Ikaalinen; Pauli Lemmetty, Tampere, both of Finland

[73] Assignee: Tamrock Oy, Finland

[21] Appl. No.: 08/776,439

[22] PCT Filed: Aug. 22, 1995

[86] PCT No.: PCT/FI95/00443

§ 371 Date: Jan. 28, 1997

§ 102(e) Date: Jan. 28, 1997

[87] PCT Pub. No.: WO96/07013

PCT Pub. Date: Mar. 7, 1996

[30] Foreign Application Priority Data

Aug. 30, 1994 [FI] Finland ..... 943980

[51] Int. Cl.[6] ..... E21B 15/04

[52] U.S. Cl. ..... 173/193

[58] Field of Search ..... 173/190, 192, 173/193, 194, 195, 184, 42, 44, 4, 13, 11

[56] References Cited

U.S. PATENT DOCUMENTS 3,462,103 8/1969 Strom .

4,116,409 9/1978 Barber et al. .

FOREIGN PATENT DOCUMENTS 227821 11/1972 Sweden .

*Primary Examiner*—Jessica J. Harrison
*Assistant Examiner*—John Paradiso
*Attorney, Agent, or Firm*—Nixon & Vanderhye P.C.

[57] ABSTRACT

An arrangement in a boom for a rock drilling unit, comprising a boom (1), pivotally connected to a frame (2) about a shaft (3), a lift cylinder (4) between the boom (1) and the frame (2), at the other end of the boom a feed beam pivotally connected about a shaft, parallel to the shaft (3), and a swing cylinder (10) between the feed beam and the boom. In the arrangement the lift cylinder (4) comprises three cylinder spaces, of which the first and second cylinder space (13*a*, 13*b*) may be connected to a hydraulic fluid supply for lifting or lowering the boom. The third cylinder space (13*c*) is inside a hollow piston rod (4*b*) and the cylinder comprises a fixed servo piston (4*c*) extending inside the piston rod. The third cylinder space (13*c*) is connected to the swing cylinder (10), to its first cylinder space (18*a*) and the second cylinder space (18*b*) of the swing cylinder (10) is connectable to a hydraulic fluid supply or receiver simultaneously with the first cylinder space (13*a*) of the lift cylinder.

4 Claims, 2 Drawing Sheets

ARRANGEMENT IN BOOM FOR ROCK DRILLING UNIT

BACKGROUND AND SUMMARY OF THE INVENTION

This invention relates to an arrangement in a boom for a rock drilling unit, comprising a boom pivotally connected to a frame, relative thereto, about a first shaft, and at the other end of the boom, relative thereto, a feed beam pivotally connected about a second shaft, parallel to the first shaft, a lift cylinder between the boom and the frame for turning the boom relative to the frame, a swing cylinder between the feed beam and the boom for turning the feed beam relative to the boom, wherein the lift cylinder comprises a first and a second cylinder space where hydraulic fluid is fed for turning the boom in different directions relative to the frame, and the swing cylinder comprises respective cylinder spaces where hydraulic fluid is fed for turning the feed beam into different directions relative to the boom.

A problem with rock drilling units is to maintain the alignment of the feed beam of the rock drill when the boom between the frame or the feed beam is horizontally or vertically turned for placing the drill rod at a new hole to be drilled. For this purpose so-called parallel automatism is normally used, wherein the pivotal movement of the boom relative to the frame is compensated for in joints between the feed beam and the boom by using separate servo cylinders, whereat the turning of the boom causes the length of one servo cylinder to change, which again causes the hydraulic fluid in a servo cylinder between the boom and the feed beam to shift so that the length of that cylinder is correspondingly changed and consequently the feed beam turns into a reverse direction relative to the end of the boom as compared with the boom relative to the frame. Such solutions are disclosed e.g. in SE patent 227821.

In known solutions, separate hydraulic cylinders, interconnected to form a closed circuit, are needed to maintain parallelism. Such a structure is, however, expensive and requires extra space around joints simultaneously increasing the number of wear components. A further problem is that, because the functioning of these cylinders has to be secured by using separate pressure-controlled non-return valves which close the pressure ducts of the cylinders so that a possible breakage of a hose does not allow the feed beam to turn freely, the amount of pressure needed to open these valves is harmful to the turning function of the boom as it resists the turning until an adequate pressure level is reached. As a result, boom control may be unsteady in the extreme angular positions, and in some cases the feed beam may even have to be moved to a more suitable position of equilibrium for proper control. This again complicates the drilling work and impairs the usability of the unit.

The object of the present invention is to provide an arrangement which eliminates problems of known solutions and provides a simple, easily and reliably functioning parallel control for a feed beam. The arrangement of the invention is characterized in that the piston rod of a lift cylinder is hollow, that the lift cylinder comprises a separate fixed piston extending into the piston rod, whereat a third cylinder space inside the piston rod is completely separate from the cylinder space, that the third cylinder space of the lift cylinder is connected with a first cylinder space of a swing cylinder, and that a second cylinder space of the swing cylinder is connectable with either a hydraulic fluid supply or correspondingly a hydraulic fluid tank simultaneously with a first cylinder space of the lift cylinder, whereat, when the lift cylinder retracts, the swing cylinder retracts correspondingly, and when the lift cylinder extends, the swing cylinder extends so as to essentially maintain the alignment of the feed beam irrespective of the swing angle of the boom.

It is an essential idea of the invention that a hydraulic cylinder between a boom and a frame is used for controlling the swing angle between a feed beam and the boom, said cylinder comprising a hollow piston rod and a separate fixed servo piston inside the piston rod so that with the piston moving relative to the cylinder, the volume of the space inside the piston rod changes correspondingly, proportionally to the travel length, whereat, with the piston rod extending inside the cylinder, the hydraulic fluid in said space flows out and may be used for controlling the cylinder between the feed beam and the boom. It is a further essential idea of the invention that hydraulic fluid is fed into a second space of the swing cylinder between the feed beam and the boom simultaneously as hydraulic fluid is fed into a cylinder between the boom and the frame, so that the fluid causes the boom to rise by feeding the swing cylinder between the feed beam and the boom into a direction where the hydraulic fluid discharged from it transmits feed pressure into the space inside the piston rod so that with the cylinder extending, i.e. the boom being lifted, both the area of the fixed piston inside the piston rod and the area of the moving piston have a parallel effect.

It is an advantage of the solution of the invention that when a boom is lifted upward, a large area may be used for the lifting, as the hydraulic fluid pressure being fed has a parallel effect in both cylinder spaces. Similarly, when a cylinder is lowered, the pressure retracting the cylinder works parallel with the weight effect of the boom, but in the cylinder space inside the piston rod, the pressure has a reverse effect thus compensating for the weight effect of the boom. Thus a better control in the lifting and lowering of the boom is achieved and simultaneously the desired parallelism in a feed beam is also maintained.

The invention will be described in greater detail with reference to the accompanying drawings.

DETAILED DESCRIPTION OF THE DRAWINGS

Figure 1:
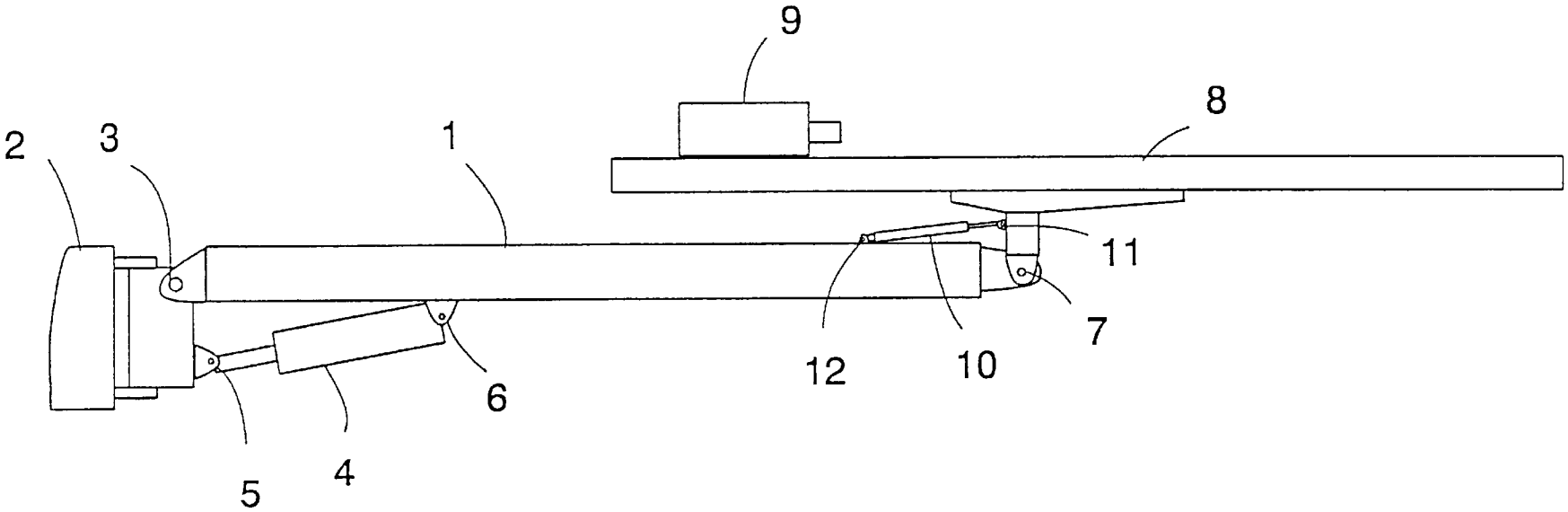
FIG. 1 schematically shows the arrangement of the invention for controlling vertical movements of a boom and a feed beam, FIG. 2 schematically shows a hydraulic coupling of the arrangement of the invention.

FIG. 1 schematically shows a boom 1, pivotally connected to a frame 2 about a horizontal first shaft 3. A lift cylinder 4, between the boom 1 and the frame 2, is connected at its ends by means of joints 5 and 6 to the frame and the boom, respectively. The other end of the boom 1 comprises a feed beam 8, pivotally connected about a horizontal second shaft 7, with a rock drill 9 moving along said feed beam 8. A swing cylinder 10, between the feed beam 8 and the boom 1, is coupled by means of joints 11 and 12 to the feed beam 8 and the boom 1, respectively.

Figure 2:
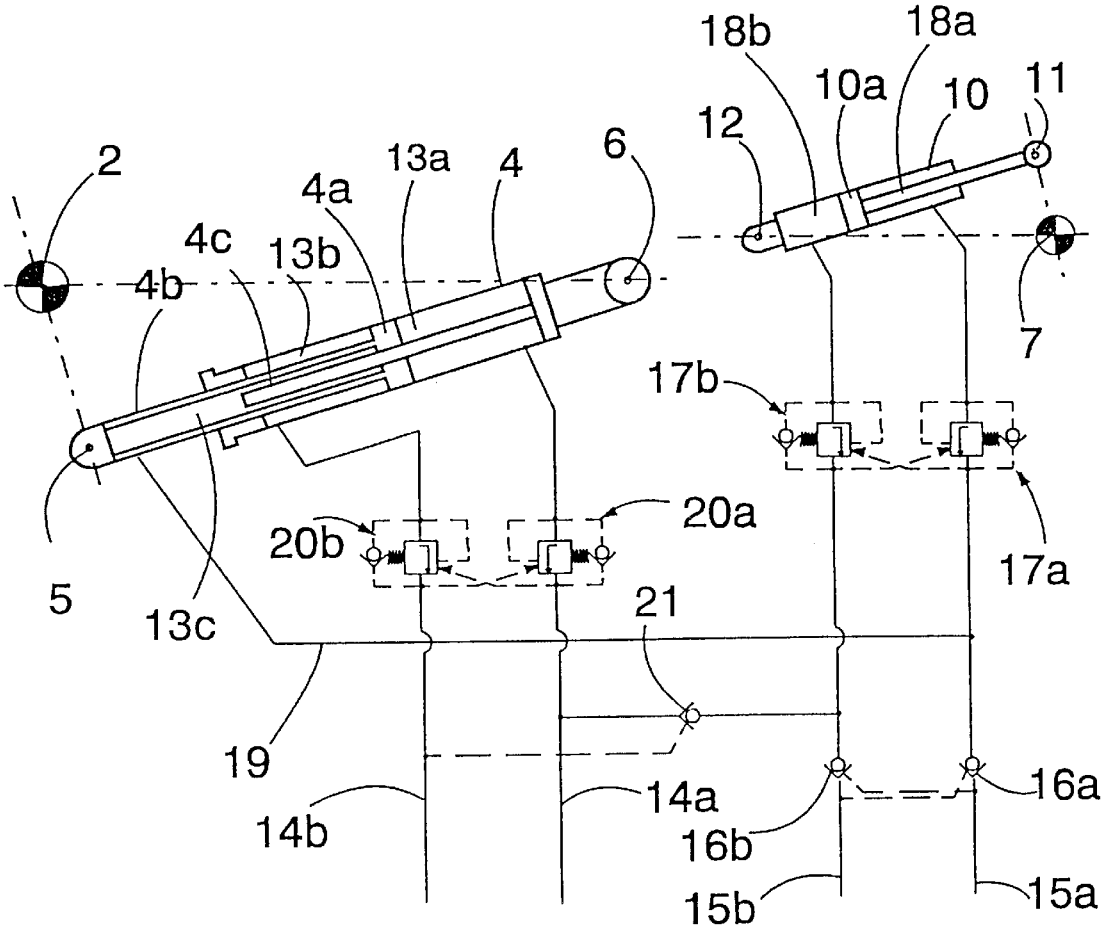

FIG. 2 schematically shows a hydraulic coupling of the apparatus of FIG. 1 relative to the lift cylinder 4 and the swing cylinder 10. As is evident from the Figure, the lift cylinder 4 comprises three cylinder spaces, with a piston 4*a* moving inside the lift cylinder 4. On both sides of the piston 4*a,* are cylinder spaces 13*a* and 13*b,* wherein hydraulic fluid is fed according to whether the piston 4*a* is required to move into the lift cylinder 4 or outward from it. A piston rod 4*b* is hollow, and the lift cylinder 4 has inside it, in the middle, a fixed servo piston 4*c,* extending into the piston rod 4*b,* whereat a third cylinder space 13*c* inside the piston rod 4*b* increases or decreases depending on the movement of the piston 4*a* relative to the cylinder 4. A first and a second hydraulic fluid line, 14*a* and 14*b,* lead to the cylinder spaces 13*a* and 13*b,* respectively.

A third and a fourth hydraulic fluid line 15*a* and 15*b* is connected to the lift cylinder 10 for separate turning of the feed beam 8, said lines being connected via pressure-controlled non-return valves 16*a* and 16*b* to pressure-controlled over-center valves 17*a* and 17*b* of the swing cylinder, and further to a first and a second hydraulic fluid space 18*a* and 18*b,* respectively, of the swing cylinder 10. Feeding hydraulic fluid into one of the lines 15*a* and 15*b* makes the swing cylinder 10 extend or retract, thereby turning the feed beam 8 relative to the boom 1. The third cylinder space 13*c* inside the piston rod 4*b* is connected via a connecting line 19 between the non-return valve 16*a* and the over-center valve 17*a* of the third hydraulic fluid line 15*a.* Respectively, the hydraulic fluid lines 14*a* and 14*b* of the lift cylinder 4 comprise over-center valves 20*a* and 20*b.* The first hydraulic fluid line 14*a* of the lift cylinder is connected via a pressure-controlled shuttle valve 21 between the pressure-controlled non-return valve 16*b* and the over-center valve 17*b* of the fourth hydraulic fluid line 15*b,* and the control pressure line of the shuttle valve 21 is connected to the second hydraulic fluid line 14*b.* The purpose of the over-center valves 17*a,* 17*b* and 20*a,* 20*b* is to keep the cylinders 10 and 4 immovable, i.e. hydraulically closed, when hydraulic fluid is not fed to either of them in any manner. Additionally, in case of overload, they allow the flow of hydraulic fluid for preventing the devices from breakage. Their function and use is obvious and generally completely known p and is thus not described here in any greater detail.

When hydraulic fluid is fed into the first cylinder space 13*a* of the lift cylinder 4, the fluid drives the piston 4*a* outward from inside the lift cylinder 4 simultaneously as hydraulic fluid flows from the second cylinder space 13*b* via the over-center valve 20*b,* opened by the incoming pressure of the first hydraulic fluid line 14*a,* into the second hydraulic fluid line 14*b* and further into a hydraulic fluid tank. Simultaneously the third cylinder space 13*c,* inside the piston rod 4*b,* increases in size. The hydraulic fluid fed into the line 14*a* affects, via the shuttle valve 21, the fourth hydraulic fluid line 15*b,* i.e. that of the swing cylinder 10, and further, via a non-return valve in its over-center valve 17*b,* the swing cylinder 10 in its cylinder space 18*b*. The hydraulic fluid pressure is transmitted via a piston 10*a* of the swing cylinder 10 to the cylinder space 18*a* and further via the over-center valve 17*a,* opened by the pressure in the line 15*b,* along the connecting line 19 to the cylinder space 13*c* of the piston rod 4*a* of the lift cylinder 4, whereat the pressure effect of the hydraulic fluid in the cylinder spaces 13*a* and 13*c* is parallel and thus facilitates the upward turning of the boom 1 in spite of its weight. Simultaneously, as the hydraulic fluid flows, it drives the piston 10*a* of the swing cylinder 10 outward from the swing cylinder 10 and consequently turns the feed beam 8 relative to the boom 1 as much as the lift cylinder 4 turns the boom 1 relative to the frame 2.

When the boom 1 is turned downward, hydraulic fluid is fed into the second cylinder space 13*b* of the lift cylinder 4, whereat the piston 4*a* is driven into the lift cylinder 4 and hydraulic fluid flows from the cylinder space 13*a* via the over-center valve 20*a* into a hydraulic fluid tank. Simultaneously, as the cylinder retracts, decreasing space causes pressure to the third cylinder space of the lift cylinder, and this pressure causes the hydraulic fluid to flow via the line 19 into the cylinder space 18*a* of the swing cylinder 10 thus shortening the swing cylinder 10. Correspondingly, hydraulic fluid flows from the second hydraulic fluid space 18*b* of the swing cylinder 10 via the pressure-controlled shuttle valve 21 opened by the pressure, in the hydraulic fluid line 14*b,* into a hydraulic fluid tank. In this way the force turning the boom 1 downward is weakened and the movement of the boom 1 becomes slower and controlled. With the piston 4*a* of the lift cylinder 4 receding into the cylinder, and thus the cylinder becoming shorter, the piston 10*a* of the swing cylinder 10 recedes therein, whereat the shortening of the whole swing cylinder corresponds to the change in the length of the lift cylinder 4, and thus the feed beam 8 turns as much as the boom 1 turns relative to the frame 2, and the feed beam is kept aligned. Simultaneously, hydraulic fluid flows from the second cylinder space 18*b* of the swing cylinder 10 via the over-center valve 17*b,* opened by the pressure from the line 19, and further via the pressure-controlled shuttle valve 21, opened by the pressure acting in the line 14*b* of the lift cylinder 4, into the line 14*a* and further into a hydraulic fluid tank.

If desired, the swing cylinder 10 may by turned for swinging the feed beam in another direction without turning the lift cylinder 4, by feeding hydraulic fluid into the third or fourth hydraulic fluid line 15*a* and 15*b*. In this case, when hydraulic fluid is fed into the line 15*a,* it flows through the non-return valve 16*a* and further through the over-center valve 17*a* into the cylinder space 18*a,* whereat the piston 10*a* penetrates into the cylinder 10. Similarly, hydraulic fluid flows from the cylinder space 18*a* through the over-center valve 17*b,* opened by the pressure of the hydraulic fluid incoming via the line 15*a,* and through the non-return valve 16*b* out via the line 15*b* and further into a hydraulic fluid tank. Similarly, when hydraulic fluid is fed into the line 15*b,* the reverse happens, whereat the piston 10*a* is expelled from the swing cylinder 10 and the discharging hydraulic fluid flows via the line 15*a* into a hydraulic fluid tank. The valves used for controlling both the lift cylinder 4 and the swing cylinder 10 are either on-off valves or proportional valves, generally known per se, by means of which the hydraulic fluid originating from a hydraulic fluid supply, such as a hydraulic fluid pump, may be directed into one of the lines simultaneously as the other line is in some manner connected to a non-pressure hydraulic fluid tank or to lower pressure. Such control valves and their function and use are also completely known per se and are therefore not described in any greater detail in this connection.

In the above description and in the drawings the invention has been described only by way of example, and it is by no means to be so restricted. Although only the vertical parallel action of the boom 1 and the arrangement needed for its realization is described in the description and the drawings, it is obvious that the same structure may suitably be applied also to controlling the horizontal movements and turning of the boom 1. It is further obvious that although no common security etc. valves are shown in the figures, they may be used in a manner known per se and be combined with the arrangement of the invention without changing the nature or idea of the invention. Input and pump solutions for hydraulic fluid may also be any kind of known solutions.

The cross-sectional area of the servo cylinder 4*c* in the lift cylinder 4 and the area of the piston connected to said cylinder space of the swing cylinder 10 do not need to be equal, as their travel lengths and cross-sectional areas may be dimensioned in different ways, provided the quantity of hydraulic fluid shifting and the dimensions of the triangles formed by the cylinder joints and swinging joints, i.e. triangles 4, 5, 6 and 7, 11, 12, respectively, are suitably similar so that a certain angle change between the boom 1 and the frame 2 results in an angle change of a corresponding width between the feed beam and the boom 1 to a reverse direction.

We claim:

1. An arrangement in a boom for a rock drilling unit, comprising:

a boom pivotally connected at one end to a frame for rotation about a first shaft, and pivotally connected at an opposite end to a feed beam mounted on the boom for rotation about a second shaft parallel to the first shaft; a lift cylinder extending between the boom and the frame for rotating the boom about said first shaft relative to the frame to thereby define a boom angle; a swing cylinder extending between the feed beam and the boom for rotating the feed beam relative to the boom about said second shaft; wherein the lift cylinder includes a hollow piston rod and a first piston defining first and second lift cylinder spaces on opposite sides of said first piston to which hydraulic fluid is fed for rotating the boom in different directions about said first shaft relative to the frame, and wherein said swing cylinder includes a second piston defining respective first and second swing cylinder spaces on opposite sides of said second piston and to which hydraulic fluid is fed for turning the feed beam in different directions about said second relative to the boom; and wherein the lift cylinder includes a separate fixed piston which extends into said hollow piston rod, thereby establishing a third cylinder space inside said hollow piston rod that is separate from the first and second lift cylinder spaces; said third cylinder space hydraulically connected with said first swing cylinder space; said second swing cylinder space being hydraulically connectable with either a hydraulic fluid supply or receiver simultaneously with said first lift cylinder space such that, when the lift cylinder retracts, the swing cylinder retracts correspondingly, and when the lift cylinder extends, the swing cylinder extends so as to substantially maintain alignment of the feed beam irrespective of the boom angle.

2. An arrangement as claimed in claim 1 and further comprising first and second hydraulic lines connected to the first and second lift cylinder spaces; and third and fourth hydraulic fluid lines connected to the first and second swing cylinder spaces, respectively, for turning the swing cylinder independently of the lift cylinder; first and second pressure-controlled non-return valves connected to the third and fourth hydraulic fluid lines respectively; said third lift cylinder space connected to a connecting line extending from between said first swing cylinder space and the first non-return valve; said lift cylinder further comprising first and second pressure-controlled over-center valves connected between said first and second lift cylinder spaces and said first and second hydraulic fluid lines, respectively; said pressure-controlled over-center valves keeping the lift cylinder locked in place, unless hydraulic fluid is fed into said lift cylinder; and wherein the second swing cylinder space is connected by means of a pressure-controlled shuttle valve to the first hydraulic fluid line leading to the first lift cylinder space and to an inlet side of the over-center valve in the first hydraulic fluid line, and further wherein a pressure control line of the pressure-controlled shuttle valve is correspondingly connected to the second hydraulic fluid line leading to the second lift cylinder space and to an inlet side of the over-center valve in the second hydraulic fluid line.

3. An apparatus as claimed in claim 2 wherein said first and second pressure-controlled over-center valves are connected to the third and fourth hydraulic fluid lines leading to the swing cylinder, between the pressure-controlled non-return valves and the swing cylinder, and wherein the connecting line leading to the third lift cylinder space is connected to the third hydraulic fluid line leading to the first swing cylinder space, between the non-return valve and the over-center valve, with the shuttle valve connected between the first hydraulic fluid line leading to the first lift cylinder space and to the fourth hydraulic fluid line leading to the second swing cylinder space between the non-return valve and the over-center valve.

4. An arrangement as claimed in claim 1 wherein the lift cylinder is connected below the boom between the boom and the frame, and the swing cylinder is connected above the boom between the boom and the feed beam.

* * * * *